US010024087B2

(12) United States Patent
Nakashima et al.

(10) Patent No.: US 10,024,087 B2
(45) Date of Patent: Jul. 17, 2018

(54) SAFETY DEVICE AND CASE WITH LID USING SAFETY DEVICE

(71) Applicants: HONDA MOTOR CO., LTD., Minato-ku, Tokyo (JP); NIFCO INC., Yokohama-shi, Kanagawa (JP)

(72) Inventors: Yu Nakashima, Wako (JP); Taku Kamiya, Wako (JP); Toshiaki Soma, Yokohama (JP)

(73) Assignees: HONDA MOTOR CO., LTD., Tokyo (JP); NIFCO INC., Yokohama-shi, Kanagawa (JP)

( * ) Notice: Subject to any disclaimer, the term of this patent is extended or adjusted under 35 U.S.C. 154(b) by 690 days.

(21) Appl. No.: 14/405,076

(22) PCT Filed: Jun. 4, 2013

(86) PCT No.: PCT/JP2013/003507
§ 371 (c)(1),
(2) Date: Dec. 2, 2014

(87) PCT Pub. No.: WO2013/183284
PCT Pub. Date: Dec. 12, 2013

(65) Prior Publication Data

US 2015/0144631 A1 May 28, 2015

(30) Foreign Application Priority Data

Jun. 4, 2012 (JP) ..... 2012-127338

(51) Int. Cl.

| | |
|---|---|
| ***E05C 19/02*** | (2006.01) |
| ***E05B 83/30*** | (2014.01) |
| ***E05B 77/06*** | (2014.01) |

(52) U.S. Cl.
CPC ..... *E05C 19/022* (2013.01); *E05B 77/06* (2013.01); *E05B 83/30* (2013.01); *Y10S 292/22* (2013.01)

(58) Field of Classification Search
CPC ..... E05C 19/02; E05C 19/022; E05C 19/063; E05B 77/02; E05B 77/04; E05B 77/06;
(Continued)

(56) References Cited

U.S. PATENT DOCUMENTS 5,211,431 A * 5/1993 Koizumi ..... E05C 19/022 292/81
5,381,586 A * 1/1995 Busscher ..... B60N 3/10 16/297

(Continued)

FOREIGN PATENT DOCUMENTS

JP 2533558 Y2 4/1997
JP 4371347 B2 11/2009

OTHER PUBLICATIONS

PCT, "International Search Report for PCT/JP2013/003507".

*Primary Examiner* — Kristina Rose Fulton
*Assistant Examiner* — Christine M Mills
(74) *Attorney, Agent, or Firm* — Manabu Kanesaka

(57) ABSTRACT

A safety device used for a case with a lid, includes a lock pin device having a responding moving member supported in the case, and a lock pin protruding from the responding moving member; a lock member provided on a lid side, and including a cam groove to receive the lock pin; and a spring member. The cam groove includes at least three first portions extending in an opening/closing direction of the lid, having an opening-directional end portion and a closing-directional end portion, and disposed in parallel at a predetermined interval therebetween; and a plurality of second portions connecting the closing-directional end portion of the first portions and intermediate portions of adjacent first portions.

(Continued)

A depth of a bottom portion between the first portion and the second portion is different to transfer the lock pin from a first of the first portions to a last of the first portions non-reversibly.

5 Claims, 10 Drawing Sheets

(58) Field of Classification Search
CPC ..... E05B 83/28; E05B 83/30; Y10S 292/04; Y10S 292/22; Y10T 292/0863; Y10T 292/0864; Y10T 292/0889; Y10T 292/0877; Y10T 292/0898; Y10T 292/54; Y10T 292/546; Y10T 292/696; Y10T 292/702; Y10T 292/0978; Y10T 292/552
USPC .... 292/57, 58, 65, 71, 83, 332, 333, 341.15, 292/341.17, DIG. 4, DIG. 22, 169.11, 334
See application file for complete search history.

(56) References Cited

U.S. PATENT DOCUMENTS

| | | | | |
|---|---|---|---|---|
| 8,052,181 | B2 * | 11/2011 | Nishida | B60N 3/083 292/332 |
| 8,393,651 | B2 | 3/2013 | Suzuki | |
| 8,567,829 | B2 | 10/2013 | Suzuki | |
| 2004/0075281 | A1 | 4/2004 | Ueki | |
| 2009/0284023 | A1 * | 11/2009 | Cho | E05B 77/06 292/34 |
| 2010/0102063 | A1 * | 4/2010 | Kogami | B60N 3/10 220/324 |
| 2010/0283267 | A1 * | 11/2010 | Suzuki | E05B 77/06 292/150 |

* cited by examiner

SAFETY DEVICE AND CASE WITH LID USING SAFETY DEVICE

RELATED APPLICATIONS

The present application is National Phase of International Application No. PCT/JP2013/003507 filed Jun. 4, 2013, and claims priority from Japanese Application No. 2012-127338 filed Jun. 4, 2012.

FIELD OF TECHNOLOGY

The present invention relates to a safety device used for a case to maintain a lid in a closed position by a push-push mechanism, and more specifically, relates to the safety device locking the lid in the closed position when the case has a predetermined acceleration so as to prevent the lid from opening unintentionally. Also, the present invention relates to a case with a lid using the safety device.

BACKGROUND ART

As for a mechanism which locks the lid turnably supported in the case in the closed position, there is conventionally used the push-push mechanism. The push-push mechanism is formed by a striker provided in one of either the lid or the case, and a locking device provided in the other of either the lid or the case. The striker is pushed into the locking device to engage with each other, and the striker is pushed into the locking device again to disengage from each other so as to facilitate an opening/closing operation of the lid (for example, Patent Document 1). However, in a case of being applied to a storage case (including a glove box) and the like, due to a deceleration or a collision of an automobile, a predetermined acceleration is applied to the case, the lid is pushed to the case by an inertia force, and the push-push mechanism releases the locking so as to have a risk that the lid opens unintentionally. In regards to this problem, there is a safety device in which a lock pin device displaced in response to the predetermined acceleration (the inertia force) is provided in the case, and a locking groove is provided in the lid, and when an acceleration is applied to the case, the displaced lock pin device is locked in the locking groove so as to prevent the lid from opening (for example, Patent Document 2).

PRIOR ART DOCUMENTS

Patent Documents

Patent Document 1: Japanese Patent Application Publication No. 2004-137725

Patent Document 2: Japanese Patent Application Publication No. 2009-155858

SUMMARY OF THE INVENTION

Problems to be Solved by the Invention

According to a study of applicants, in the storage case of the automobile, as shown in FIG. 10, it is recognized that due to sudden braking or a front collision of a vehicle, a reciprocating movement vibrating in an opening/closing direction occurs in the lid of the storage case. This is because a backward acceleration is generated in the storage case by a rapid deceleration of the vehicle, and the inertia force occurs in the lid, so that the lid moves in a closing direction, and a return sway occurs so as to allow the lid to move in an opening direction. Vibrations in the opening/closing direction of the lid are also recognized when an object collides with the lid in the same manner. The safety device according to the Patent Document 2 includes one locking groove, and a lock pin is locked in the locking groove, so that when the lid is displaced into the closing direction, and the push-push mechanism releases the locking, the safety device according to the Patent Document 2 prevents the lid from opening only once. In a case wherein the lid moves in the closing direction again, the locking of the lock pin by the locking groove is released, so that there is a risk that the lid opens unintentionally by the vibrations of the lid.

The present invention is made in view of the aforementioned backgrounds, and in a safety device used for the case to maintain the lid in the closed position by the push-push mechanism, an object of the present invention is to reliably maintain the lid in a closed state in a case wherein the acceleration occurs in the case, and the vibrations in the opening/closing direction are generated in the lid. Also, another object of the present invention is to provide a case with a lid using the safety device.

Means for Solving the Problems

In order to obtain the aforementioned objects, the present invention is a safety device (5) used for a case with a lid (1) and comprising a case (2); a lid (3) openably and closably supported in the case; and a push-push mechanism (4) provided between the case and the lid, locking the lid by a push operation into a closing direction, and releasing the locking of the lid by a next push operation into the closing direction. The safety device (5) includes a lock pin device (70) including a responding moving member (74) supported in the case to be displaceable within a predetermined range, urged by a spring in a predetermined direction, and when the case receives an acceleration in a direction reverse to the aforementioned predetermined direction, generating an inertia force against an urging force of the spring to be displaced in the direction reverse to the aforementioned predetermined direction, and a lock pin (78) provided in such a way as to protrude from the responding moving member; a lock member (28) provided on the aforementioned lid side, and including a cam groove to receive the lock pin when the lid is positioned in a closed position, and the responding moving member is displaced in the direction reverse to the predetermined direction against the urging force of the spring; and a spring member (81) always urging the lock pin toward the cam groove. The cam groove (71) includes at least three first portions (97) extending in an opening/closing direction of the lid, having an opening-directional side end portion where the lock pin is positioned by a closing-directional movement of the lid and a closing-directional side end portion where the lock pin is positioned by an opening-directional movement of the lid, and mutually disposed in parallel at a predetermined interval therebetween; and a plurality of second portions (98) connecting the closing-directional side end portion of the first portions and intermediate portions in the opening/closing direction of adjacent first portions. The first (97) of the first portions (97), disposed on the furthest one side among the first portions, where the second portion is not connected to the intermediate portion in the opening/closing direction, receives the lock pin, and the last (97) of the first portions (97) disposed on the other side among the first portions, where the second portion is not connected to the closing-directional side end portion, forms an open end to allow the lock pin to be disengaged relative to the opening-directional movement of the lid. Also, a depth of a bottom portion of an area between the first portion and the second portion changes in such a way that the lock pin in a state of being received in the cam groove transfers from the first of the first portions to the last of the first portions non-reversibly cooperating with an urging force of the spring member by a reciprocating movement into the opening/closing direction of the lid.

According to the structure, the cam groove includes the plurality of first portions and second portions, so that in order to be disengaged from the lock pin, the reciprocating movement into the opening/closing direction of the lid is required multiple times. Consequently, even in a case wherein the acceleration is generated in the case, and vibrations are generated in the lid, the safety device can easily maintain the locking of the lid.

In the aforementioned invention, it is preferable that at least four first portions are provided.

According to the structure, even in the case wherein the acceleration is generated in the case, and the vibrations are generated in the lid, the safety device can easily maintain the locking of the lid even further.

In the aforementioned invention, it is preferable that the second portions are connected relative to the first portions at the closing-directional side end portion in such a way as to make an acute angle.

According to the structure, if the lid does not reliably reciprocate in the opening/closing direction in a proper stroke, the lock pin cannot be disengaged from the cam groove so as to become difficult to release the locking by the safety device.

In the aforementioned invention, the responding moving member may be turnably supported in the case, and be urged by the spring in a predetermined turning direction as well, or the responding moving member may be slidably supported in the case, and be urged by the spring in a predetermined slide direction as well.

According to the structure, a structure of the lock pin device can be simplified.

Also, the present invention may be the case with a lid comprising the safety device of the aforementioned invention.

Effect of the Invention

According to the aforementioned structures, in the safety device used for the case to maintain the lid in the closed position by the push-push mechanism, in the case wherein the acceleration is generated in the case, and the vibrations in the opening/closing direction of the lid are generated in the lid, the lid can be reliably maintained in the closed state. Also, the case with a lid using the aforementioned safety device can be provided.

BRIEF DESCRIPTION OF THE DRAWINGS

FIGS. 9(A) to 9(C) show a lock pin device according to another embodiment, wherein FIG. 9(A) is an exploded perspective view; FIG. 9(B) is a side view; and FIG. 9(C) is a plan view.

BEST MODES OF CARRYING OUT THE INVENTION

Hereinafter, with reference to the drawings, examples wherein a safety device according to embodiments of the present invention is applied to a storage case provided at a center portion of an instrument panel of an automobile will be explained. In the following explanation, based on the automobile to which the storage case is attached, each direction of front and back, right and left, and up and down will be determined.

Figure 1:
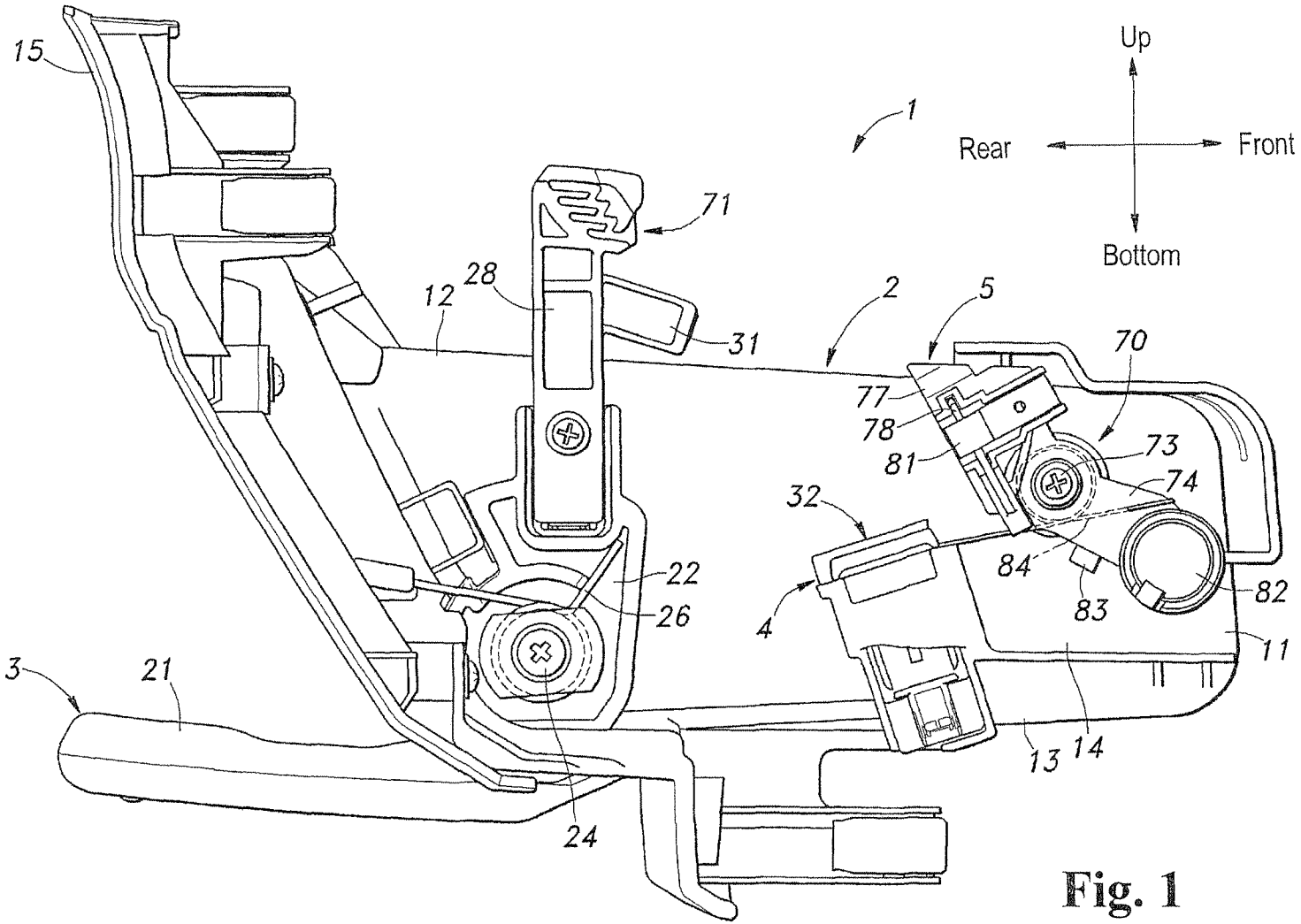
FIG. 1 is a side view showing an open state of a storage case.
Figure 2:
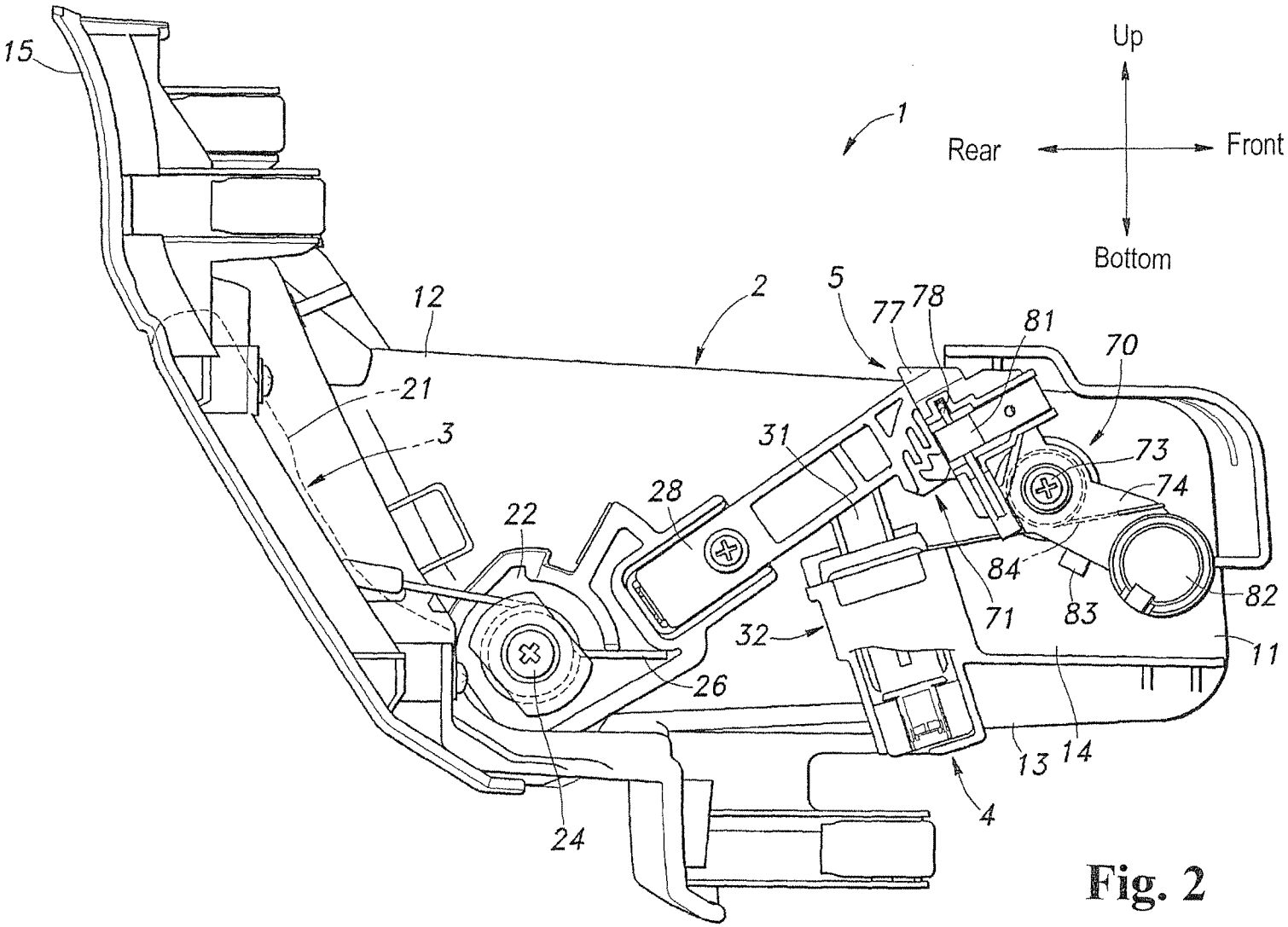
FIG. 2 is a plan view showing a closed state of the storage case.

As shown in FIG. 1 and FIG. 2, a storage case 1 includes a case 2 opening backward; a lid 3 opening and closing an opening of a box body; a push-push mechanism 4 locking the lid 3 at a closed position relative to the case 2; and a safety device 5 maintaining the lid 3 at the closed position in a case wherein the storage case 1 has a predetermined acceleration.

The case 2 includes a front side wall 11; and an upper wall 12, a lower wall 13, and right and left side walls 14, respectively extending backward from an upper edge, a lower edge, a left side edge, and a right side edge of the front side wall 11, and opens backward. At back edges of the upper wall 12, and the right and left side walls 14, there is formed a flange 15 extending to an outside of the opening. The case 2 is housed in the opening formed at the center portion of the instrument panel of the automobile, and the flange 15 covers a gap between the flange 15 and the instrument panel, and forms an interior side face.

The lid 3 includes a lid main body 21 formed in an approximately square plate shape, and a pair of arms 22 respectively provided to project at lower portions of right and left side portions of the lid main body 21. The pair of arms 22 respectively extends to outsides of the right and left side walls 14. At mutually facing portions between each arm 22 and the right and left side walls 14, there are respectively provided support shafts 24 passing through the arms 22 and connected to the side walls 14 in such a way as to become mutually coaxial, and by the support shafts 24, the lid 3 including the arms 22 is supported in the case 2 to turn as support shafts of the support shafts 24. The lid 3 can turn between an open position where an upper edge of the lid main body 21 is spaced from the opening of the case 2, and the lid main body 21 becomes approximately horizontal as shown in FIG. 1; and a closed position where the upper edge of the lid main body 21 is adjacent to the back edge of the upper wall 12 of the case 2, and the lid main body closes the opening of the case 2 as shown in FIG. 2. Between the arms 22 and the right and left side walls 14, there are provided torsion springs 26 whose one end is locked in the arms 22, and whose other end is locked in the side walls 14 coaxially with the support shafts 24. The torsion springs 26 urge the lid 3 into the open position. Also, in the arm 22, there is connected a plate-piece-like lock member 28 extending in an approximately orthogonal direction (a radial direction) relative to a rotational shaft of the arm 22.

The push-push mechanism 4 is formed by a striker 31 provided to project at an intermediate portion in a longitudinal direction of the lock member 28, and a locking device 32 connected to outer surfaces of the side walls 14 of the case 2. The striker 31 protrudes approximately along a circumferential direction (a tangential direction) around the rotational shaft of the arm 22, and includes a locking claw 33 protruding to a side wall 14 side on a face facing the side wall 14 side of the case 2. As shown in FIG. 1, the striker 31 and the locking device 32 are spaced from each other when the lid 3 is located in the open position, and as shown in FIG. 2, when the lid 3 is located in the closed position, the striker 31 enters into the locking device 32 to be locked.

Figure 3:
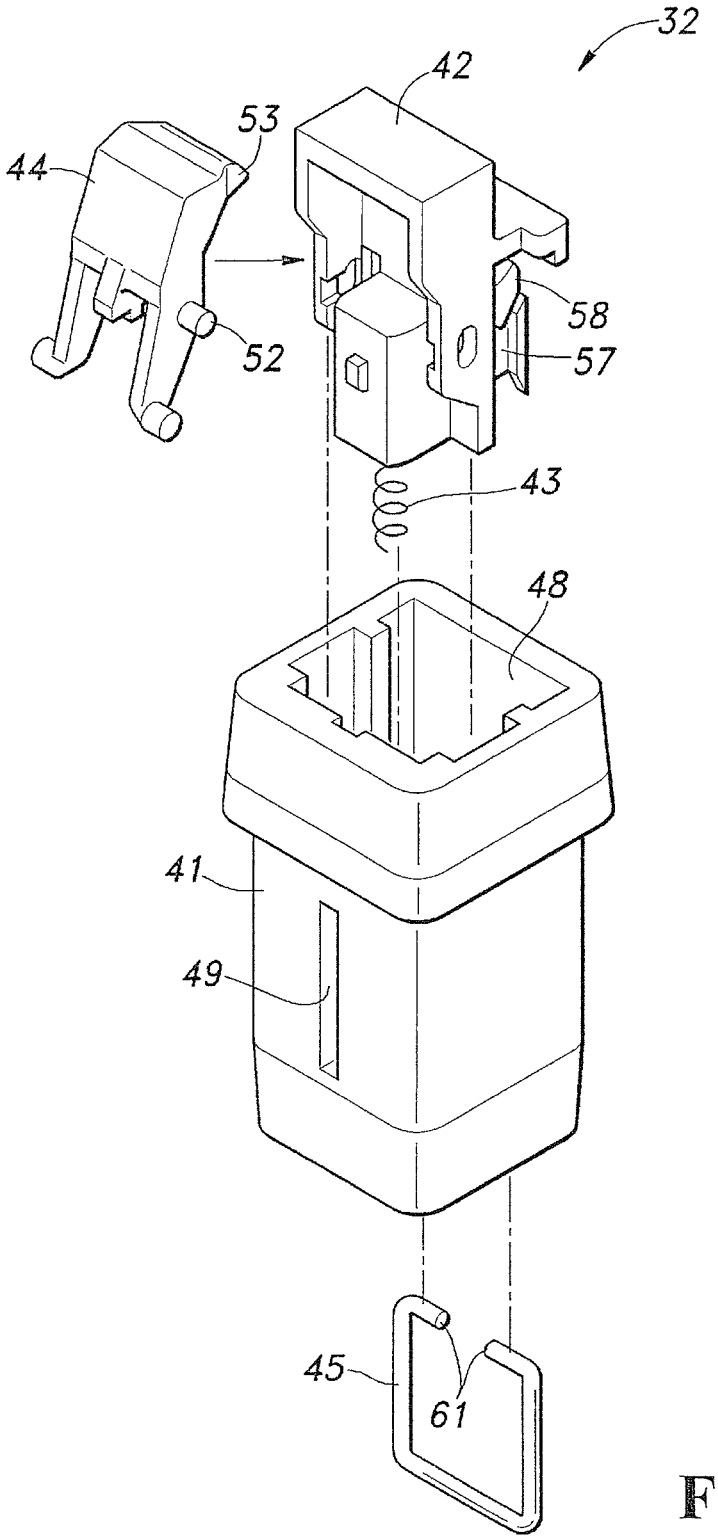
FIG. 3 is an exploded perspective view showing a push-push mechanism.
Figure 4:
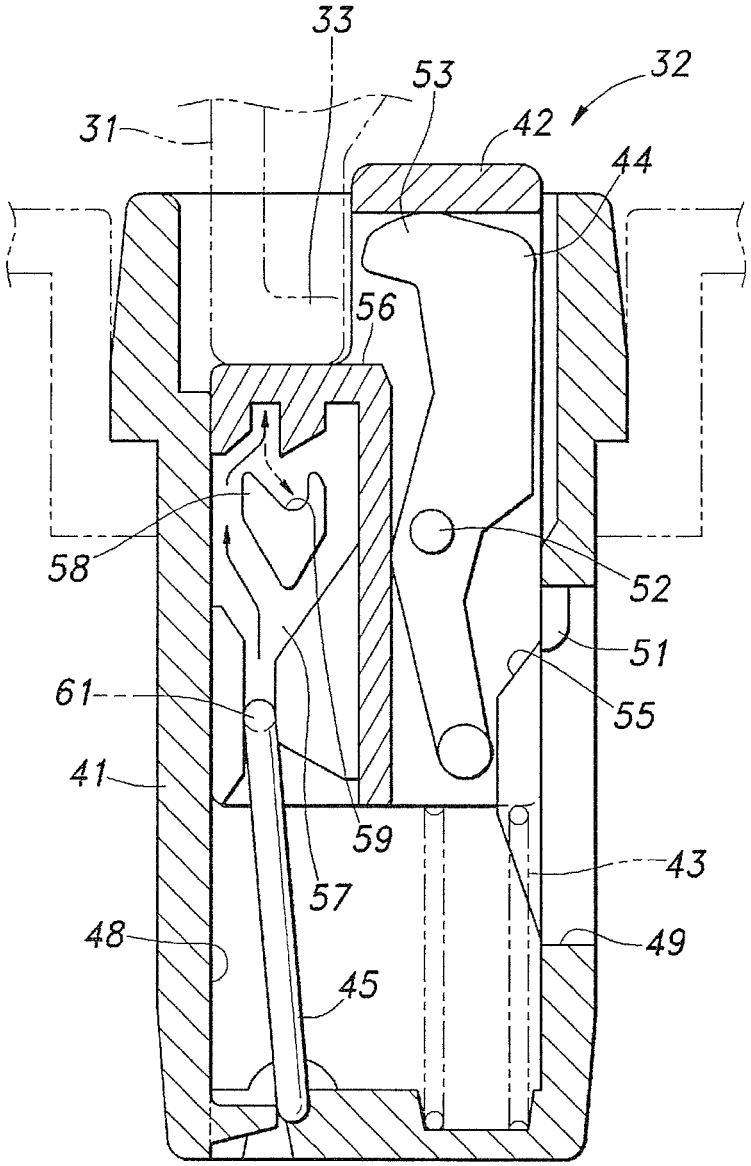
FIG. 4 is a cross-sectional view showing a release state of the push-push mechanism.
Figure 5:
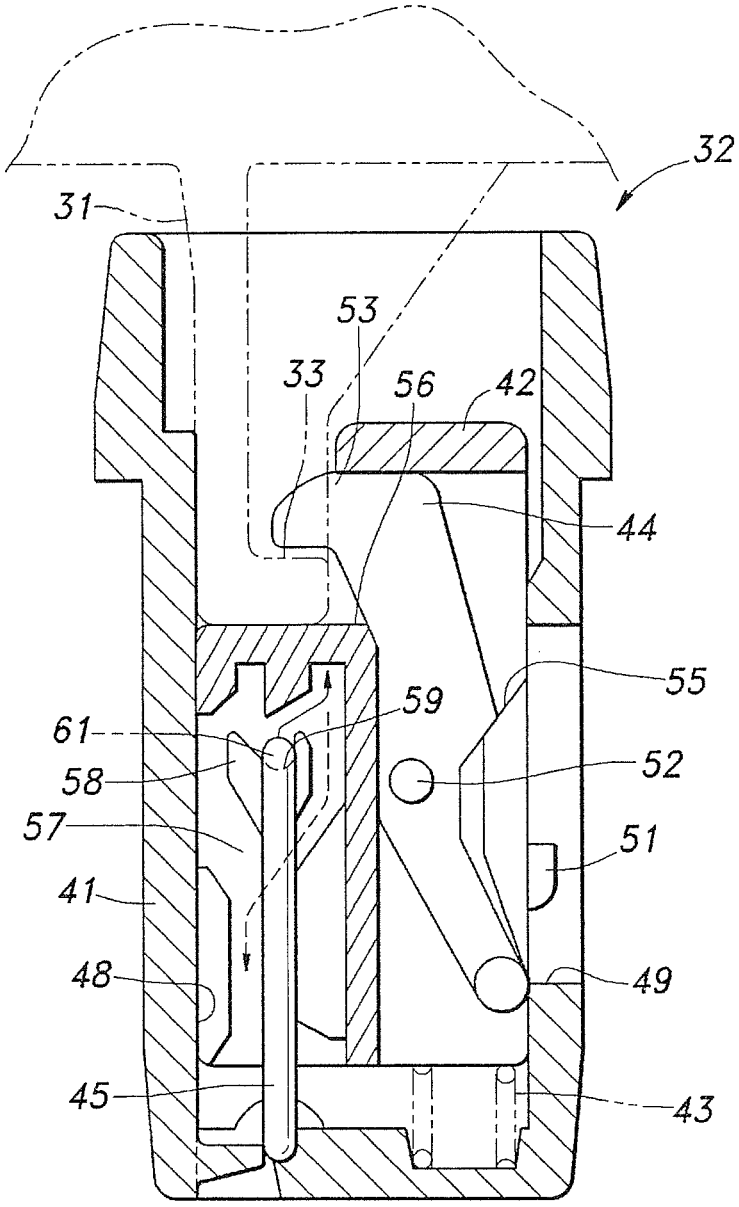
FIG. 5 is a cross-sectional view showing a lock state of the push-push mechanism.

As shown in FIG. 3 to FIG. 5, the locking device 32 is an alternate-type locking device using a heart cam, and includes a housing 41 connected to the outer surfaces of the side walls 14, and formed in a box shape in which a striker 31 side is open; a slider 42 slidably supported inside the housing 41; a compression coil spring 43 interposed between the housing 41 and the slider 42, and urging the slider 42; a latch claw 44 turnably supported in the slider 42, and engaging with the striker 31; and a locking pin 45 supported in the housing 41, and locking the slider 42.

The housing 41 extends in one direction, and includes an inner hole 48 opening at one end (an end portion facing the striker 31) of the housing 41. At a side portion of the inner hole 48, there is formed a guide groove 49 penetrating into an outside face of the housing 41, and extending in an extending direction of the inner hole 48. The slider 42 includes a guide convex portion 51 entering into the guide groove 49. Thereby, the slider 42 can slide between a protruding position where the guide convex portion 51 abuts against an end wall on an opening end side of the inner hole 48 of the guide groove 49; and an entered position where a bottom portion of the slider 42 abuts against a bottom portion of the inner hole 48. The compression coil spring 43 is interposed between the bottom portion of the slider 42 and the bottom portion of the inner hole 48, and urges the slider 42 into the protruding position.

The latch claw 44 is rotatably supported in the slider 42 at a support shaft 52 provided to project at an intermediate portion in a longitudinal direction. The latch claw 44 includes a locking claw 53 protruding laterally (a rotational direction of the latch claw) at one end in the longitudinal direction. As shown in FIG. 4 and FIG. 5, on a lateral face of the inner hole 48 of the housing 41, there is provided to project a trapezoidal cam convex portion 55 abutting against a lateral face of the latch claw 44. As shown in FIG. 4, when the slider 42 is positioned in the protruding position, the latch claw 44 abuts against the cam convex portion 55, so that the latch claw 44 inclines relative to the slider 42, and the locking claw 53 takes a posture of being entered into a through hole 56 formed in the housing 41. On the other hand, as shown in FIG. 5, when the slider 42 is located in the entered position, the latch claw 44 abuts against the cam convex portion 55, so that the latch claw 44 extends approximately parallel to the slider 42, and the locking claw 53 passes through the through hole 56 to take a posture of protruding laterally.

As shown in FIG. 3 to FIG. 5, on a lateral face of the slider 42, there is formed a cam groove 57. The cam groove 57 is formed in a groove of a closed-loop which becomes an open heart shape, and forms a cam wall 58 which becomes a heart shape viewed from the side at a portion surrounded by the cam groove 57. The cam wall 58 includes a locking concave portion 59 concaved downward at an upper portion.

The locking pin 45 is formed in a rectangular frame shape whose upper portion is cleaved, and whose lower portion is supported in the housing 41, and the upper portion can turn around the lower portion. Upper ends of the locking pin 45 are bent approximately at right angles to become locking end portions 61, and are entered into the cam groove 57.

In the push-push mechanism 4 formed in the above-mentioned manner, when the lid 3 turns into the closed position, the striker 31 presses the slider 42 of the locking device 32 against an urging force of the compression coil spring 43, and the slider 42 moves into the entered position from the protruding position. At that time, the latch claw 44 is pressed by the cam convex portion 55 to turn, and the locking claw 53 passes through the through hole 56 and protrudes outward to lock the locking claw 33 of the striker 31. Thereby, the striker 31 is locked in the locking device 32. At that time, the locking end portion 61 of the locking pin 45 is guided along solid arrows in FIG. 4 inside the cam groove 57, and moves to an upper end of the cam groove 57. In that state, when a turn of the lid 3 halts, the slider 42 is urged by the compression coil spring 43 to move upward. At that time, the locking end portion 61 of the locking pin 45 is guided downward inside the cam groove 57 as shown with a dashed line arrow in FIG. 4 to be locked in the locking concave portion 59 of the cam wall 58. Thereby, an upward movement of the slider 42 is regulated, the slider 42 is maintained near the entered position, and the striker 31 is maintained in a state of being locked in the locking device 32. Namely, the lid 3 is maintained in the closed position.

When the lid 3 is pressed into the closed position again from a state wherein the lid 3 is maintained in the closed position, the slider 42 moves into the entered position by the striker 31 against the urging force of the compression coil spring 43. At that time, as shown with a solid arrow in FIG. 5, the locking end portion 61 of the locking pin 45 is guided upward inside the cam groove 57 to move. The cam groove 57 guides the locking end portion 61 in a series of directions such that the locking end portion 61 does not return to a route where the locking end portion 61 passes when the locking end portion 61 reaches the locking concave portion 59 relative to an upward movement of the locking end portion 61. When a push into the closed position of the lid 3 halts, the slider 42 moves into the protruding position by being urged by the compression coil spring 43, and the locking end portion 61 is guided by the cam groove 57 in such a way as to avoid the locking concave portion 59 so as to return to an initial position. In the slider 42, the guide convex portion 51 abuts against an end portion of the guide groove 49, so that the slider 42 is maintained in the protruding position. At that time, the latch claw 44 is pressed by the cam convex portion 55 to turn, and the locking claw 53 enters into the through hole 56, and releases locking of the locking claw 33 of the striker 31. Thereby, locking of the striker 31 by the locking device 32 is released, and the lid 3 is urged by the torsion spring 26 to be displaced into the open position.

As mentioned above, the push-push mechanism 4 is formed such that by pushing the lid 3 into the closed position, the striker 31 is locked in the locking device 32 to maintain the lid 3 in the closed position, and by pushing the lid 3 into the closed position again, the locking of the striker 31 by the locking device 32 is released to allow the lid 3 to turn.

As shown in FIG. 1, the safety device 5 is formed by a lock pin device 70 supported in the side wall 14 of the case 2; and a cam groove 71 formed on a lateral face of an end portion of the lock member 28.

Figure 6:
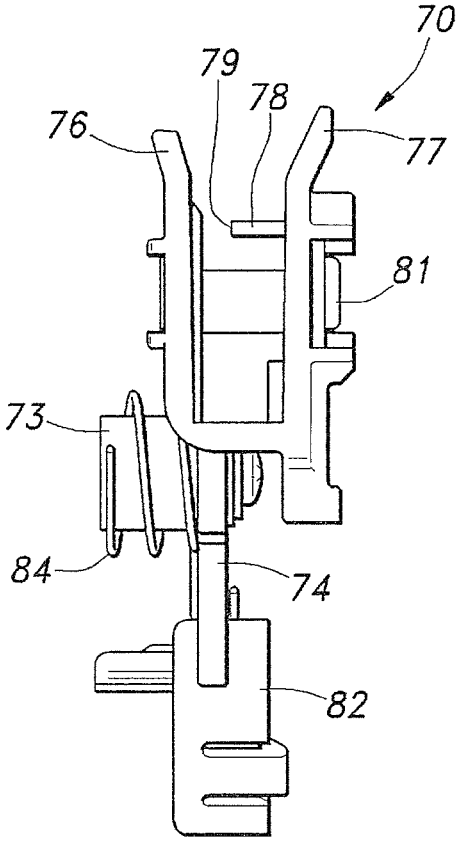
FIG. 6 is a side view showing an acceleration detecting mechanism.

The lock pin device 70 includes a responding moving member 74 turnably supported in a support shaft 73 connected to the outer surface of the side wall 14 of the case 2. The responding moving member 74 is supported in the support shaft 73 at an intermediate portion in a longitudinal direction. As shown in FIG. 6, one end portion in the longitudinal direction of the responding moving member 74 is branched into two, mutually extends approximately in parallel, and forms an inner plate portion 76 and an outer plate portion 77 mutually overlapped in a right-and-left direction. The inner plate portion 76 is disposed on the side wall 14 side more than the outer plate portion 77 at a predetermined distance, and there is formed a gap between the inner plate portion 76 and the outer plate portion 77. In the outer plate portion 77, there is formed a through hole (not shown in the figure), and in the through hole, there is inserted one end of a lock pin 78 made of metal and bent in an L shape. One end portion of the lock pin 78 passes through the outer plate portion 77 from an outside to an inside, and is disposed between the outer plate portion 77 and the inner plate portion 76 to become a loose end 79. The other end portion of the lock pin 78 is urged into an outer surface of the outer plate portion 77 by a plate spring 81, and is pressed against the outer surface of the outer plate portion 77. Consequently, the plate spring 81 bends, so that the loose end 79 of the lock pin 78 can be displaced in the right-and-left direction. In the other end portion in the longitudinal direction of the responding moving member 74, there is attached a weight 82.

In the responding moving member 74, the lock pin 78 is disposed above and behind the support shaft 73, and the weight 82 can be located in a predetermined initial position (see FIG. 1) where the weight 82 is disposed below and in front of the support shaft 73. On the outer surface of the side wall 14, there is provided to project a stopper 83, and the stopper 83 abuts against the responding moving member 74, so that the responding moving member 74 is not allowed to turn in a rotational direction (a clockwise direction around the support shaft 73 in FIG. 1) where the lock pin 78 moves forward more than the initial position. The responding moving member 74 can turn in a rotational direction (a counterclockwise direction around the support shaft 73 in FIG. 1) where the lock pin 78 moves backward more than the initial position within a predetermined range. Between the responding moving member 74 and the side wall 14, there is interposed a torsion spring 84 whose one end is locked in the responding moving member 74 and whose other end is locked in the side wall 14, and the torsion spring 84 is urged in a direction where the responding moving member 74 abuts against the stopper 83, i.e., in a direction where the responding moving member 74 is located in the initial position.

In the lock pin device 70 formed in the aforementioned manner, for example, in a case of a sudden stop, a front collision, or the like of a vehicle, when a backward acceleration is generated in the storage case 1, the weight 82 moves forward by an inertia force, the responding moving member 74 rotates counterclockwise around the support shaft 73 against an urging force of the torsion spring 84, and the lock pin 78 moves backward. Namely, the lock pin device 70 is formed such that in a case wherein the storage case 1 has a predetermined acceleration, the lock pin device 70 turns, and the lock pin 78 moves backward.

Figure 7:
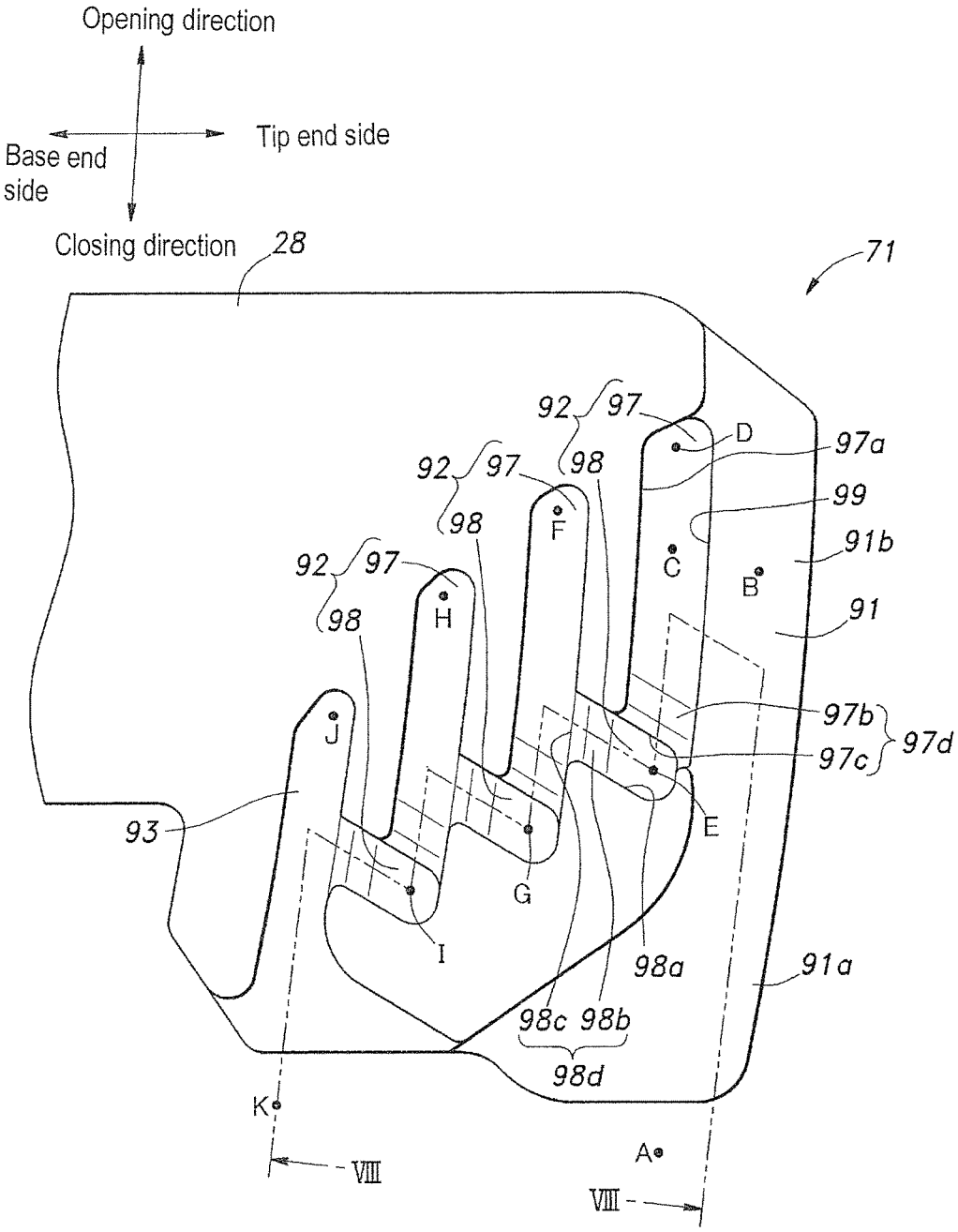
FIG. 7 is a side view showing a locking groove of a safety device.
Figure 8:
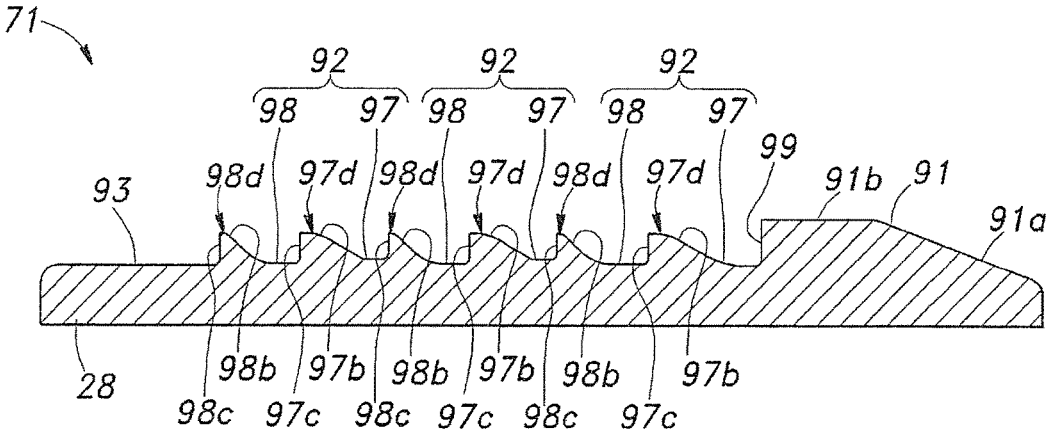
FIG. 8 is a cross-sectional view taken along a line VIII-VIII in FIG. 7.

With reference to FIG. 1, FIG. 7, and FIG. 8, the cam groove 71 will be explained. In the following explanation, as shown in FIG. 7, a tip side and a base end side in the longitudinal direction of the lock member 28 are simply called a tip side and a base end side; in a circumferential direction around the support shaft 24, a direction wherein the lock member 28 moves when the lid 3 moves into the closed position is simply called a closing direction; and a direction wherein the lock member 28 moves when the lid 3 moves into the open position is simply called an opening direction. As shown in FIG. 7, the cam groove 71 is formed on a lateral face facing outward and opposed to a face facing the side wall 14 side of the lock member 28, and is formed by a plurality of locking grooves 92 and an exit groove 93 disposed on base end sides of the locking grooves 92. At tip sides of the plurality of locking grooves, there is formed a reciprocating passage 91.

The reciprocating passage 91 extends along the circumferential direction around the support shaft 24, and continues to a closing-directional side edge and an opening-directional side edge of the lock member 28. As shown in FIG. 7 and FIG. 8, a closing-directional side portion 91*a* of the reciprocating passage 91 becomes an inclined face in such a way as to move to the side wall 14 side as moving in the closing direction. Also, as the closing-directional side portion 91*a* moves in the closing direction, a passage of the closing-directional side portion 91*a* widens. An opening-directional side portion 91*b* of the reciprocating passage 91 is formed on a face parallel to an outside face of the lock member 28, more specifically, on a face parallel to a flat surface orthogonal to the support shaft 24.

Each locking groove 92 extends along the circumferential direction around the support shaft 24, and includes a first groove (a first portion) 97 having an opening-directional side end portion and a closing-directional side end portion in an extending direction; and a second groove 98 having one end continuing to the closing-directional side end portion of the first groove 97, inclining relative to the first groove 97 to the base end side and in the opening direction from one end to the other end, and extending in a linear manner. Namely, the second groove 98 is connected to the first groove 97 at the closing-directional side end portion in such a way as to make an acute angle with the first groove 97, and the locking groove 92 formed by the first groove 97 and the second groove 98 has a shape expressed by a hook shape or a V shape.

The first groove 97 is a groove provided to be concaved relative to the outside face of the lock member 28, and a circumference thereof is surrounded by an edge wall 97*a* which becomes vertical relative to the outside face of the lock member 28 except for a portion communicated with the second groove 98. A bottom portion of the first groove 97 is formed in a flat surface which becomes approximately parallel to the outside face of the lock member 28. At an end portion on a closing direction side of the first groove 97, there is formed a non-return convex portion 97*d* including an inclined face 97*b* rising as moving in the closing direction, and a non-return wall 97*c* formed on a closing direction side of the inclined face 97*b* and becoming vertical relative to the outside face of the lock member 28. A protruding height of the non-return convex portion 97*d* does not reach the outside face of the lock member 28.

The second groove 98 is a groove provided to be concaved relative to the outside face of the lock member 28, and a circumference thereof is surrounded by an edge wall 98*a* which becomes vertical relative to the outside face of the lock member 28 except for a portion communicated with the first groove 97 and an end portion on a base end side of the second groove 98. A bottom portion of the second groove 98 is formed in a flat surface which becomes approximately parallel to the outside face of the lock member 28, and has a depth which is approximately the same as that of the bottom portion of the first groove 97. At a boundary portion between the second groove 98 and the first groove 97, there is disposed the non-return wall 97*c* of the non-return convex portion 97*d* of the first groove 97. At an end portion on the base end side of the second groove 98, there is formed a non-return convex portion 98*d* including an inclined face 98*b* rising as moving toward the base end side, and a non-return wall 98*c* formed on the base end side of the inclined face 98*b* and becoming vertical relative to the outside face of the lock member 28. A protruding height of the non-return convex portion 98*d* does not reach the outside face of the lock member 28.

In the present embodiments, there are provided three locking grooves 92, and a base end portion of the second groove of one locking groove 92 is arranged in the longitudinal direction of the lock member 28 in such a way as to be communicated with an intermediate portion (more specifically, a portion on an opening direction side more than the non-return convex portion 97*d*) of the first groove 97 of the locking groove 92 disposed on the base end side thereof.

In the locking groove 92 disposed on the most tip side among the three locking grooves 92, the first groove 97 thereof does not include the edge wall 97*a* at a tip side edge, and is disposed in such a way as to follow the opening-directional side portion 91*b* of the reciprocating passage 91. The first groove 97 is formed deeper than the opening-directional side portion 91*b*, and at a boundary between the first groove 97 and the opening-directional side portion 91*b*, there is formed a non-return wall 99 which becomes vertical relative to the outside face of the lock member 28.

In the locking groove 92 disposed on the most base end side among the three locking grooves 92, the end portion on the base end side of the second groove 98 thereof continues to the exit groove 93. The exit groove 93 extends along the circumferential direction around the support shaft 24, and forms an open end connected to the closing-directional side edge of the lock member 28. A bottom portion of the exit groove 93 is formed on the face parallel to the outside face of the lock member 28. The exit groove 93 is disposed parallel to the first groove 97, and has a shape similar to the first groove 97.

In the safety device 5 formed in the aforementioned manner, when the lid 3 turns into the closed position, a tip portion of the lock member 28 enters between the inner plate portion 76 and the outer plate portion 77 of the lock pin device 70, and the loose end 79 of the lock pin 78 moves up on the closing-directional side portion 91*a* of the reciprocating passage 91 from a position A, and slides on the reciprocating passage 91 into a position B. At that time, the loose end 79 of the lock pin 78 is pressed against a surface of the reciprocating passage 91 by the plate spring 81. The closing-directional side portion 91*a* is formed on the inclined face, so that the loose end 79 can easily move up on the reciprocating passage 91. Due to locking of the push-push mechanism 4, in a state wherein the lid 3 is locked near the closed position, the loose end 79 of the lock pin 78 is positioned on the position B. In a case wherein the storage case 1 does not have the predetermined acceleration, and the locking by the push-push mechanism 4 is released, the loose end 79 slides on the reciprocating passage 91 toward the position A, and is disengaged from the closing-directional side portion 91*a*. Thus, in the case wherein the storage case 1 does not have the predetermined acceleration, the safety device 5 does not regulate the turn of the lid 3, so that the lid 3 can be freely open and closed.

Next, when the lid 3 is locked by the push-push mechanism 4, and the loose end 79 of the lock pin 78 is located in the position B, the case wherein the storage case 1 has the predetermined acceleration will be explained. Due to sudden braking or a front collision of the vehicle, a predetermined backward acceleration (a deceleration) is generated in the storage case 1. Thereby, the responding moving member 74 of the lock pin device 70 turns against the urging force of the torsion spring 84 by the inertia force, and the loose end 79 of the lock pin 78 moves into a position C from the position B so as to be positioned at the first groove 97 of the locking groove 92.

At that time, the loose end 79 climbs over the non-return wall 99, and is urged by the plate spring 81 to slidingly contact with the bottom portion of the first groove 97, so that the loose end 79 cannot return to the reciprocating passage 91 from the first groove 97. In a state wherein the loose end 79 is positioned in the position C, when the lid 3 is displaced into the closing direction by the inertia force, or by an object colliding with the lid 3, the loose end 79 moves into a position D. At that time, by a displacement into the closing direction of the lid 3, the push-push mechanism 4 releases the locking. Thereby, the lid 3 is displaced into the opening direction by an urging force of the torsion spring 26. Also, even by a return sway, the lid 3 is displaced into the opening direction. Due to a displacement into the opening direction of the lid 3, the loose end 79 slides in the first groove 97 from the position D, climbs over the non-return convex portion 97*d*, and reaches a position E inside the second groove 98. When the loose end 79 reaches the position E, the loose end 79 is caught on the edge wall 98*a* on a closing direction side of the second groove 98 so as to prevent the lid 3 from moving into the opening direction. Thereby, the lid 3 is prevented from unintentionally opening.

Also, in a case wherein the return sway of the lid 3 continues, the lid 3 is displaced into the closing direction again, and the loose end 79 is guided into the base end side of the second groove 98 while sliding on the non-return wall 97*c* of the non-return convex portion 97*d* and on the edge wall 98*a* on the opening direction side of the second groove 98; climbs over the non-return convex portion 98*d*; and moves to the first groove 97 of the next locking groove 92 positioned on the base end side to move into a position F. Then, by the urging force of the torsion spring 26, or the return sway of the lid 3, the lid 3 is displaced into the opening direction, and the loose end 79 moves into a position G from the position F, and abuts against the edge wall 98*a* on the closing direction side of the second groove 98 so as to prevent the lid 3 from moving into the opening direction. In a case wherein the return sway of the lid 3 is sufficiently attenuated, the loose end 79 is maintained in a state of being located in the position G, and in a case wherein the return sway of the lid 3 is still continuing, by the return sway, the lid is displaced in the closing direction, and the loose end 79 passes through the second groove 98 and the first groove 97 to move into a position H. Thus, even if a reciprocating movement into the opening/closing direction of the lid 3 is generated, the loose end 79 is maintained in the position E, the position G, or a position I of the second groove 98 so as to prevent the lid 3 from unintentionally opening.

In order to release locking by the safety device 5 to open the lid 3, the lid 3 may be pushed into the closing direction multiple times. For example, in a case wherein the loose end 79 is located in the position E, the lid 3 is pushed in three times; in a case wherein the loose end 79 is located in the position G, the lid 3 is pushed in twice; and in a case wherein the loose end 79 is located in the position I, the lid 3 is pushed in once, so that the loose end 79 reaches the exit groove 93, and the loose end 79 is disengaged from the cam groove 71 so as to allow the lid 3 to turn.

In the present embodiments, there are provided four first grooves 97 including the exit groove 93, and the first grooves 97 are connected by the second grooves 98, so that even if the lid 3 is reciprocating (vibrating) by the return sway, the lock pin cannot be easily disengaged from the cam groove 71, and the lid 3 is maintained in a state of being closed by the safety device 5.

Specific embodiments have been explained above; however, the present invention is not limited to the aforementioned embodiments, and can be widely modified. For example, in the present embodiments, there are provided the three locking grooves 92 (the four first grooves 97 including the exit groove 93); however, there may be provided two or more locking grooves 92. Incidentally, it is preferable to have three or more locking grooves 92.

Figure 9A:
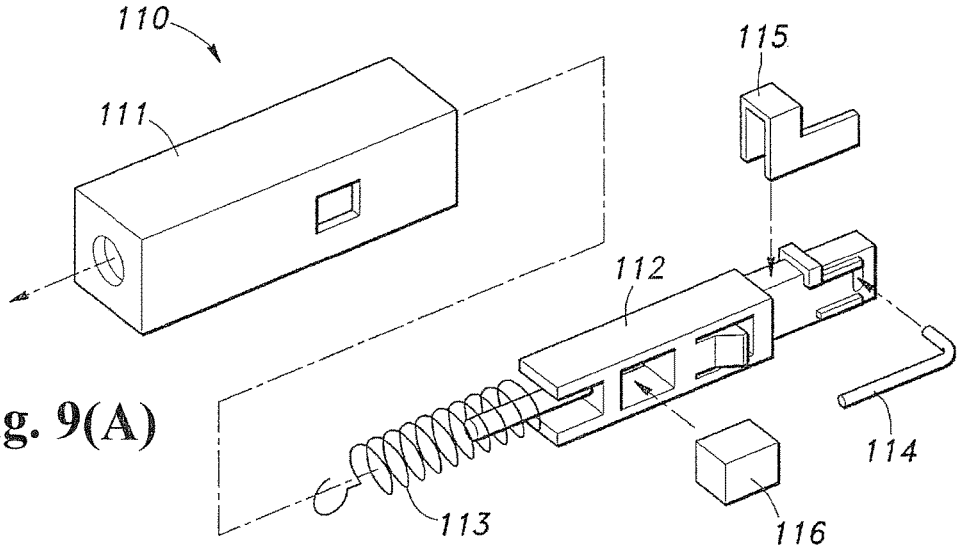
Figure 9B:
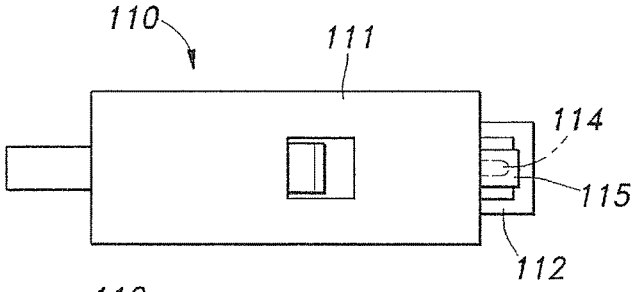
Figure 9C:
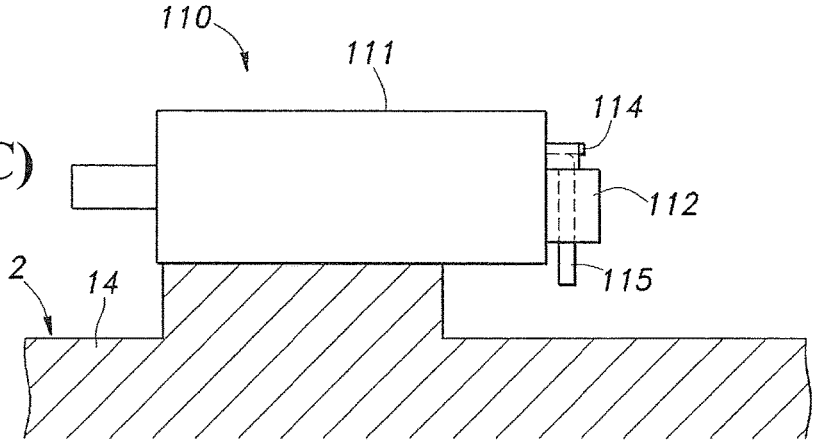
Figure 10:
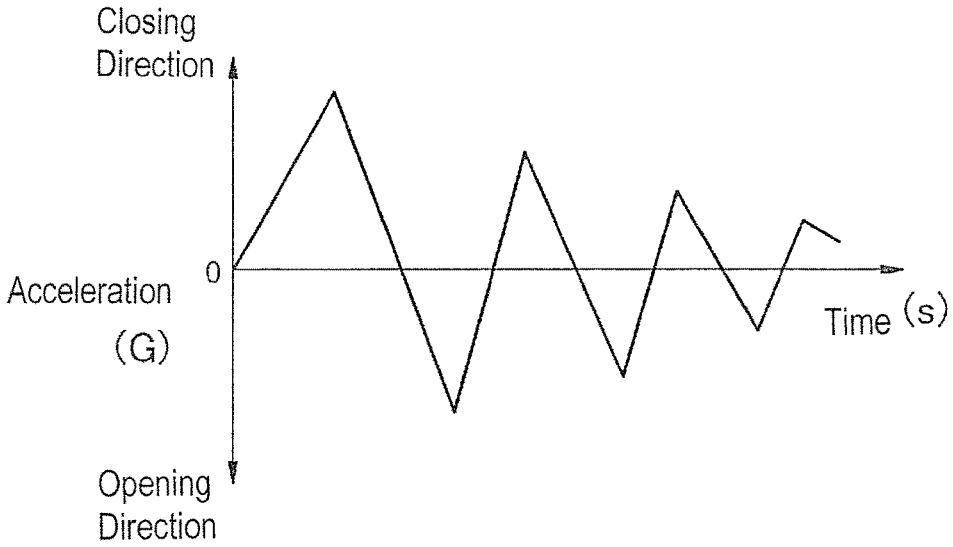
FIG. 10 is an explanatory drawing showing a behavior of a lid when an automobile decelerates, and an inertia force is applied to the lid of the storage case.

The lock pin device 70 explained in the aforementioned embodiments is an illustrated example, and various modified examples can be applied. For example, as shown in FIGS. 9(A) to 9(C), a lock pin device 110 may include a housing 111 fixed to the side wall 14 of the case 2; a responding moving member (a slider) 112 slidably supported in the housing 111; a tension coil spring 113 whose one end is locked in the housing 111 and whose other end is locked in the responding moving member 112, and urging the responding moving member 112 to an inside of the housing 111; a lock pin 114 formed in an L shape, in which one end portion is inserted in such a way as to pass through a through hole formed in the responding moving member 112; a plate spring 115 fitted in the responding moving member 112 and urging the lock pin 114 in a direction wherein one end portion of the lock pin 114 protrudes from the responding moving member 112; and a weight 116 connected to the responding moving member 112. In the lock pin device 110, when an acceleration is generated in the storage case 1, an inertia force is generated in the responding moving member 112, the responding moving member 112 slides to an outward side of the housing 111 against an urging force of the tension coil spring 113, and the lock pin 114 moves. Thus, in the lock pin devices 70 and 110, the responding moving member 74 is not limited to the responding moving member turning in response to the inertia force, and the responding moving member may be ones provided that they move the lock pins 78 and 114 in response to a predetermined inertia force such as the responding moving member 112 which slides and the like.

In the aforementioned embodiments, the examples, in which the case according to the present invention is applied to the storage case provided at the center portion of the instrument panel of the automobile, have been shown; however, the safety device of the present invention can be applied to various cases in which the acceleration can be generated, for example, a glove box for a front passenger seat of the automobile and the like. Also, the safety device of the present invention may be applied to furniture and the like so as to prevent a door from unintentionally opening at a time when an earthquake occurs.

EXPLANATION OF SYMBOLS

1 . . . a storage case, 2 . . . a case, 3 . . . a lid, 4 . . . a push-push mechanism, 5 . . . a safety device, 24 . . . a support shaft, 28 . . . a lock member, 31 . . . a striker, 32 . . . a locking device, 70 . . . a lock pin device, 71 . . . a cam groove, 74 . . . a responding moving member, 78 . . . a lock pin, 79 . . . a loose end, 81 . . . a plate spring, a weight, 91 . . . a reciprocating passage, 92 . . . a locking groove, 93 . . . an exit groove (the last of first portions), 97 . . . a first groove (a first portion), 97*d* . . . a non-return convex portion, 98 . . . a second groove (a second portion), 98*d* . . . a non-return convex portion, 99 . . . a non-return wall

What is claimed is:

1. A safety device in combination with a case having a lid and a push-push mechanism openably and closably supported by the case, including the push-push mechanism provided between the case and the lid, locking the lid by a push operation into a closing direction, and releasing a locking of the lid by a next push operation into the closing direction, comprising:

a lock pin device including a responding moving member adapted to be supported in the case to be displaceable within a predetermined range, urged by a spring in a predetermined direction, and when the case receives an acceleration in a direction reverse to the predetermined direction, generating an inertia force against an urging force of the spring to be displaced in the direction reverse to the predetermined direction, and a lock pin provided to protrude from the responding moving member;

a lock member adapted to be provided on a lid side, and including a cam groove to receive the lock pin when the lid is positioned in a closed position and the responding moving member is displaced in the direction reverse to the predetermined direction against the urging force of the spring; and a spring member always urging the lock pin toward the cam groove, wherein the cam groove includes:

a reciprocating groove adapted to extend in an opening/closing direction of the lid, and having an opening-directional side end portion where the lock pin is positioned by a closing-directional movement of the lid and a closing-directional side end portion where the lock pin is positioned by an opening-directional movement of the lid, a first first-portion arranged adjacent to the reciprocating groove, a second first-portion arranged adjacent to the first first-portion at a side opposite to the reciprocating groove, a third first-portion situated adjacent to the second first-portion at a side opposite to the first first-portion, an exit groove arranged adjacent to the third first-portion at a side opposite to the second first-portion, and forming an open end to disengage the lock pin relative to the opening-directional movement of the lid, a first second-portion connecting a closing-directional side end portion of the first first-portion and an intermediate portion in the opening/closing direction of the second first-portion, a second second-portion connecting an end of the second first-portion to an intermediate portion of the exit groove in the opening/closing direction of the third first-portion, a third second-portion connecting an end of the third first-portion to an intermediate portion of the exit groove, the second second-portion being connected to the exit groove through the third first-portion and the third second-portion, a depth of bottom portions of the first first-portion, the second first-portion, the first second-portion, and the second second-portion changes so that the lock pin in a state of being received in the cam groove is transferred from the first first-portion to the first second-portion non-reversibly cooperating with an urging force of the spring member by a reciprocating movement in the opening/closing direction of the lid, the lock pin is located in the reciprocating groove upon opening and closing the lid when the case receives no acceleration in the direction reverse to the predetermined direction, and the lock pin enters the first first-portion when the responding moving member is displaced in the direction reverse to the predetermined direction against the urging force of the spring, and exits from the exit groove through the second first-portion, third first-portion, the first second-portion, second second-portion, and the third second-portion, and the reciprocating groove, the first first-portion, the second first-portion, the third first-portion and the exit groove are arranged parallel to each other, and ends of the first first-portion, the second first-portion, the third first-portion and the exit groove at portions away from the first second-portion, the second second-portion and the third second-portion are inclined relative to a longitudinal direction of the responding moving member.

2. A safety device according to claim 1, wherein the first second-portion is connected to the first first-portion at the closing-directional side end portion to form an acute angle.

3. A safety device according to claim 1, wherein the responding moving member is adapted to be turnably supported in the case, and wherein the predetermined direction is a turning direction.

4. A safety device according to claim 1, wherein the responding moving member is adapted to be slidably supported in the case, and wherein the predetermined direction is a slide direction.

5. A case with a lid including the safety device according to claim 1.

* * * * *